US009472906B2

(12) United States Patent
Humburg et al.

(10) Patent No.: US 9,472,906 B2
(45) Date of Patent: Oct. 18, 2016

(54) CONTROL DEVICE FOR A VEHICLE HEATER

(71) Applicant: Eberspächer Climate Control Systems GmbH & Co. KG, Esslingen (DE)

(72) Inventors: Michael Humburg, Göppingen (DE); Hermann Eppler, Balingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 0 days.

(21) Appl. No.: 14/602,587

(22) Filed: Jan. 22, 2015

(65) Prior Publication Data

US 2015/0214676 A1 Jul. 30, 2015

(30) Foreign Application Priority Data

Jan. 24, 2014 (DE) ..... 10 2014 201 317
Mar. 27, 2014 (DE) ..... 10 2014 205 744

(51) Int. Cl.
*H01R 13/627* (2006.01)
*H01R 13/66* (2006.01)
*H01R 13/502* (2006.01)
*H01R 31/06* (2006.01)

(52) U.S. Cl.
CPC ..... *H01R 13/665* (2013.01); *H01R 13/502* (2013.01); *H01R 13/6658* (2013.01); *H01R 31/065* (2013.01)

(58) Field of Classification Search
CPC ..... H01R 13/665; H01R 13/502; H01R 13/6658; H01R 31/065
USPC ..... 439/350, 76.1, 76.2
See application file for complete search history.

(56) References Cited

U.S. PATENT DOCUMENTS 4,899,256 A * 2/1990 Sway-Tin ..... H05K 7/20854 361/715
5,569,039 A * 10/1996 Bailey ..... B60R 16/02 439/76.1
5,749,516 A * 5/1998 Humburg ..... F24H 9/2085 237/12.3 C
6,572,412 B2 * 6/2003 Beuther ..... H05K 5/0069 439/381
7,455,552 B1 * 11/2008 Fang ..... H05K 3/284 439/606
7,597,560 B2 * 10/2009 Korich ..... B60L 11/14 439/34
7,616,448 B2 * 11/2009 Degenkolb ..... H05K 3/284 174/50.5

(Continued)

FOREIGN PATENT DOCUMENTS

EP 1034983 A2 9/2000
RU 21462 U1 1/2002
RU 2195404 C1 12/2002

OTHER PUBLICATIONS

Russian Search Report of Feb. 25, 2016.

*Primary Examiner* — Tulsidas C Patel
*Assistant Examiner* — Peter G Leigh
(74) *Attorney, Agent, or Firm* — McGlew and Tuttle, P.C.

(57) ABSTRACT

A control device for a vehicle heater includes a circuit assembly unit (12) with a plurality of external contacts (24), an external receptacle (30) for receiving an external plug (42) for establishing an electrical contact with the external contacts (24) for connecting the control device (10) to a vehicle wiring system, as well as a circuit assembly unit housing (18) surrounding the circuit assembly unit (12) with an external receptacle tunnel (52) surrounding at least partially the external receptacle (30).

20 Claims, 6 Drawing Sheets

(56) References Cited

U.S. PATENT DOCUMENTS 7,719,833 B2 * 5/2010 Inagaki ..... B60R 16/0239 165/80.3
7,755,907 B2 * 7/2010 Inagaki ..... B60R 16/0239 174/50.5
7,950,931 B2 * 5/2011 Nakanishi ..... H02G 3/088 439/76.2
8,023,273 B2 * 9/2011 Chlumsky ..... H05K 5/006 174/50.52
8,693,205 B2 * 4/2014 Moser ..... B60R 16/0239 361/752
8,770,989 B2 * 7/2014 Ohhashi ..... H01R 13/5202 439/589
9,093,776 B2 * 7/2015 Yamanaka ..... H05K 5/0069
9,184,640 B2 * 11/2015 Morimoto ..... H02K 9/22
9,360,532 B2 * 6/2016 Kikuchi ..... H01M 10/48
2002/0024800 A1 * 2/2002 Skofljanec ..... H05K 5/006 361/752
2003/0161110 A1 * 8/2003 Spasevski ..... H05K 7/20854 361/715

* cited by examiner

CONTROL DEVICE FOR A VEHICLE HEATER

CROSS REFERENCE TO RELATED APPLICATIONS

This application claims the benefit of priority under 35 U.S.C. §119 of German Patent Applications DE 10 2014 201 317.8 filed Jan. 24, 2014 and DE 10 2014 205 744.2 filed Mar. 27, 2014, the entire contents of which are incorporated herein by reference.

FIELD OF THE INVENTION

The present invention pertains to a control device for a vehicle heater, which may be used, for example, in a vehicle as a parking heater or auxiliary heater.

BACKGROUND OF THE INVENTION

The design of such vehicle heaters, which are designed, in general, as air or water heaters and are operated for the most part with fuel, may be such that a control device is arranged in the area of a blower, which delivers the combustion air for a burner area and optionally also the heating air that is to be heated. The control device comprises a housing, in which a circuit assembly unit, for example, in the form of a printed circuit board, is accommodated. Such a control device, controlling or regulating the operation of a heater, is connected electrically to a vehicle wiring system via a cable harness, which has a plug at one end area of a cable establishing the wire connection for being plugged into a corresponding receptacle in a vehicle and is connected, in general, rigidly, for example, by soldering, to the circuit assembly unit at its other end area. This cable of the cable harness can be led out of the heater in the area of ducts in the housing of the control device, on the one hand, and in a heater housing, on the other hand, and a plurality of openings may be provided, for example, in the heater housing for passing through the cable.

SUMMARY OF THE INVENTION

An object of the present invention is to provide a control device for a vehicle heater, which control device makes possible a cost-effective wire connection to a vehicle wiring system, on the one hand, and, on the other hand, to a component of the vehicle heater, which component can be actuated by the control device, while having a simple design, which also guarantees a high level of variability.

This object is accomplished according to the present invention by a control device for a vehicle heater, comprising a circuit assembly unit with a plurality of external contacts, an external receptacle for receiving an external plug for establishing an electrical contact with the external contacts for connecting the control device to a vehicle wiring system, as well as a circuit assembly unit housing surrounding the circuit assembly unit with an external receptacle tunnel surrounding the external receptacle at least partially.

In the control device designed according to the present invention, the cable harness, establishing a wire connection to a vehicle wiring system, does not form an assembly unit built rigidly together with the control device itself. This causes the cable harness, which is very cost-intensive in the overall system of a vehicle heater, not to form part of the heater or control device for a vehicle heater. While the variability concerning the design of such a cable harness is increased, the manufacturing costs for the control device itself can be reduced. The cable harness can then be selected in a vehicle-specific manner, so that one and the same control device can be used in connection with different vehicles in a simple manner by correspondingly selecting the cable harness establishing the wire connection.

To make it also possible in a control device according to the present invention to integrate same in a vehicle heater in a simple manner, it is proposed that the external receptacle tunnel comprise a holding meshing formation (engagement structure) for providing a holding meshing (a connected engagement) with a heater housing. For example, the holding meshing formation may comprise a housing meshing groove for the holding meshing of at least one housing part of a heater housing. Due to the interaction of this holding meshing formation with a heater housing, stable holding of the control device can be achieved without further design measures being necessary therefor, for example, a blower motor or another component.

It is proposed in one embodiment, which has an especially simple design and can be manufactured in a cost-effective manner, that the circuit assembly unit housing comprise a first circuit assembly unit housing part with a preferably plate-like (plate) or shell-like (shell) first housing section carrying the external receptacle tunnel and being preferably designed integrally therewith. Since such housing parts are manufactured, in general, of plastic material, for example, in an injection molding process, it is correspondingly possible in a simple manner, for example, to form the external receptacle tunnel integrally with the housing section, i.e., as a block of material. Additional fastening measures for the external receptacle tunnel can thus be avoided.

To leave an intermediate space, for example, for the flow of air, between the essential volume area of the control device or the circuit assembly unit housing thereof and a heater housing carrying this, it is proposed that the holding meshing formation be arranged on the external receptacle tunnel at a spaced location from the first housing section.

The entry of contaminants or moisture into the interior space of the circuit assembly unit housing can be prevented or at least made difficult by the first circuit assembly unit housing part being sealed in an essentially fluid-tight manner relative to the external receptacle. If the external receptacle is made separately from the circuit assembly unit housing, this fluid-tight connection may be embodied, for example, by interposing a sealing element.

It is proposed in an embodiment variant that is especially advantageous concerning the fluid-tight sealing that can be achieved, on the one hand, and concerning the simple design, on the other hand, that the external receptacle tunnel and the external receptacle be formed integrally with the first circuit assembly unit housing part. This integral design may be embodied, for example, in an injection molding process when manufacturing the first circuit assembly unit housing part from a plastic material, so that the first circuit assembly unit housing part is provided with the external receptacle and with the external receptacle tunnel as a block of material.

To ensure that an external plug, plugged onto the control device, cannot accidentally separate from the control device during the operation of a vehicle, it is proposed that a holding formation for establishing a holding connection with an external plug be provided on the external receptacle or/and the external receptacle tunnel. Provisions may be made in this case, for example, for the holding formation to comprise at least one snap-in projection or/and at least one snap-in recess or/and at least one catch spring.

To accommodate an external plug in the external receptacle, the latter may have a control device recess. The external contacts originating from the circuit assembly unit may extend into the receptacle recess for electrical interaction with complementary contacts provided in an external plug.

To establish an electrical connection with an internal plug, by which at least one heater component can be connected to the control device, the circuit assembly unit may have a plurality of internal contacts.

To make it also possible to protect these internal contacts extending from the circuit assembly unit and to guarantee a stable plug-type connection, it is proposed that an internal receptacle tunnel surrounding the internal contacts at least partially be provided on the circuit assembly unit housing.

The circuit assembly unit housing may comprise a second circuit assembly unit housing part with a preferably plate-like or shell-like, second housing section carrying the internal receptacle tunnel, which is preferably formed integrally therewith. This second housing section may be connected with the first housing section of the first circuit assembly unit housing part such that it surrounds the circuit assembly unit. An interior space, in which the circuit assembly unit can be accommodated, especially such that it is protected against external effects, is thus bordered by the two housing sections.

To avoid a mutual interference between the internal receptacle tunnel and other components accommodated in the interior of a heater housing, it is proposed that the external receptacle tunnel and the internal receptacle tunnel be arranged offset in relation to one another on the circuit assembly unit housing.

The present invention pertains, further, to a vehicle heater with a control device designed according to the present invention. This control device may be carried on a heater housing by means of the external receptacle tunnel.

The present invention will be described in detail below with reference to the attached drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
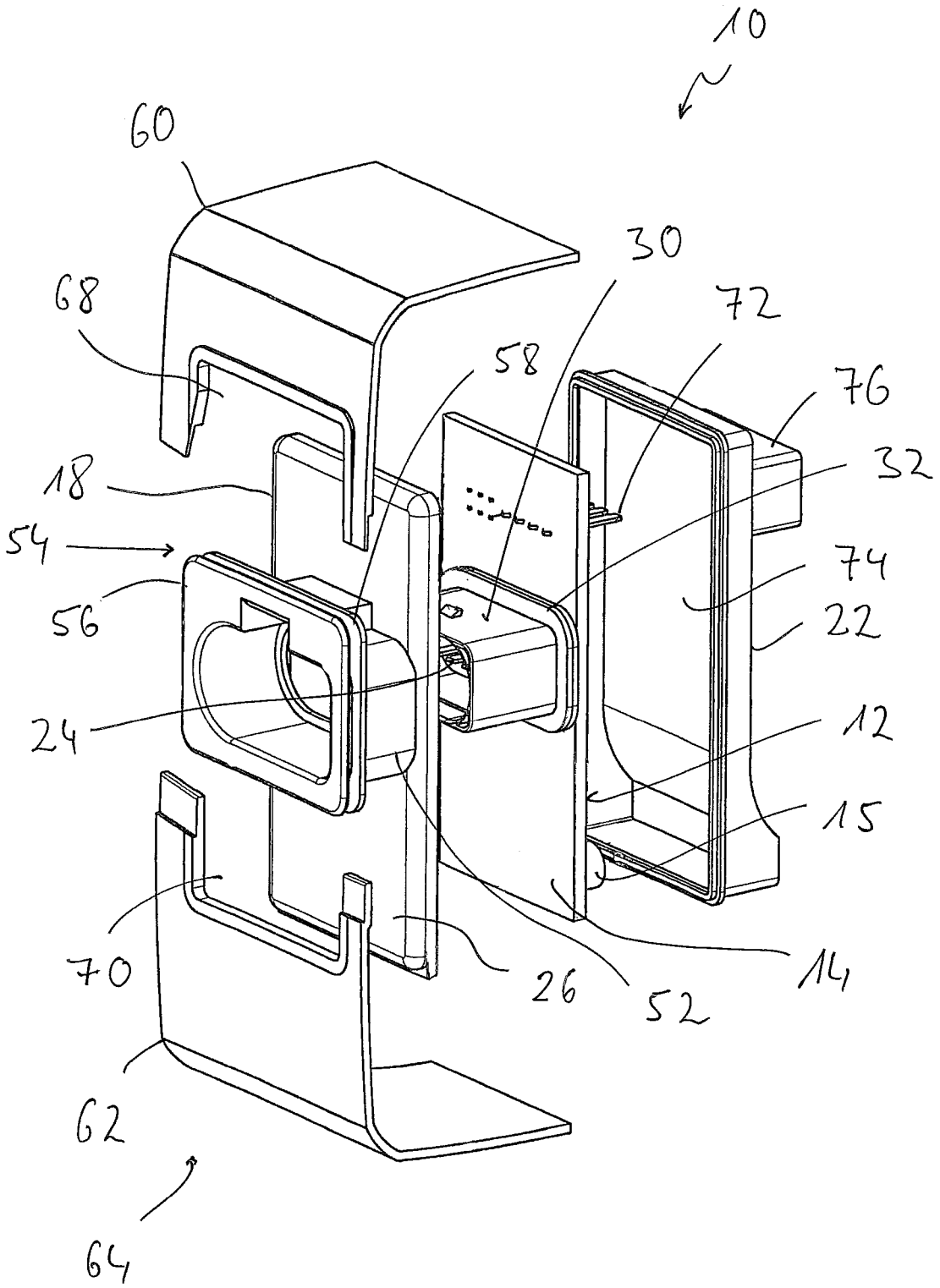
FIG. 1 is a perspective exploded view of a control device for a vehicle heater.
Figure 2:
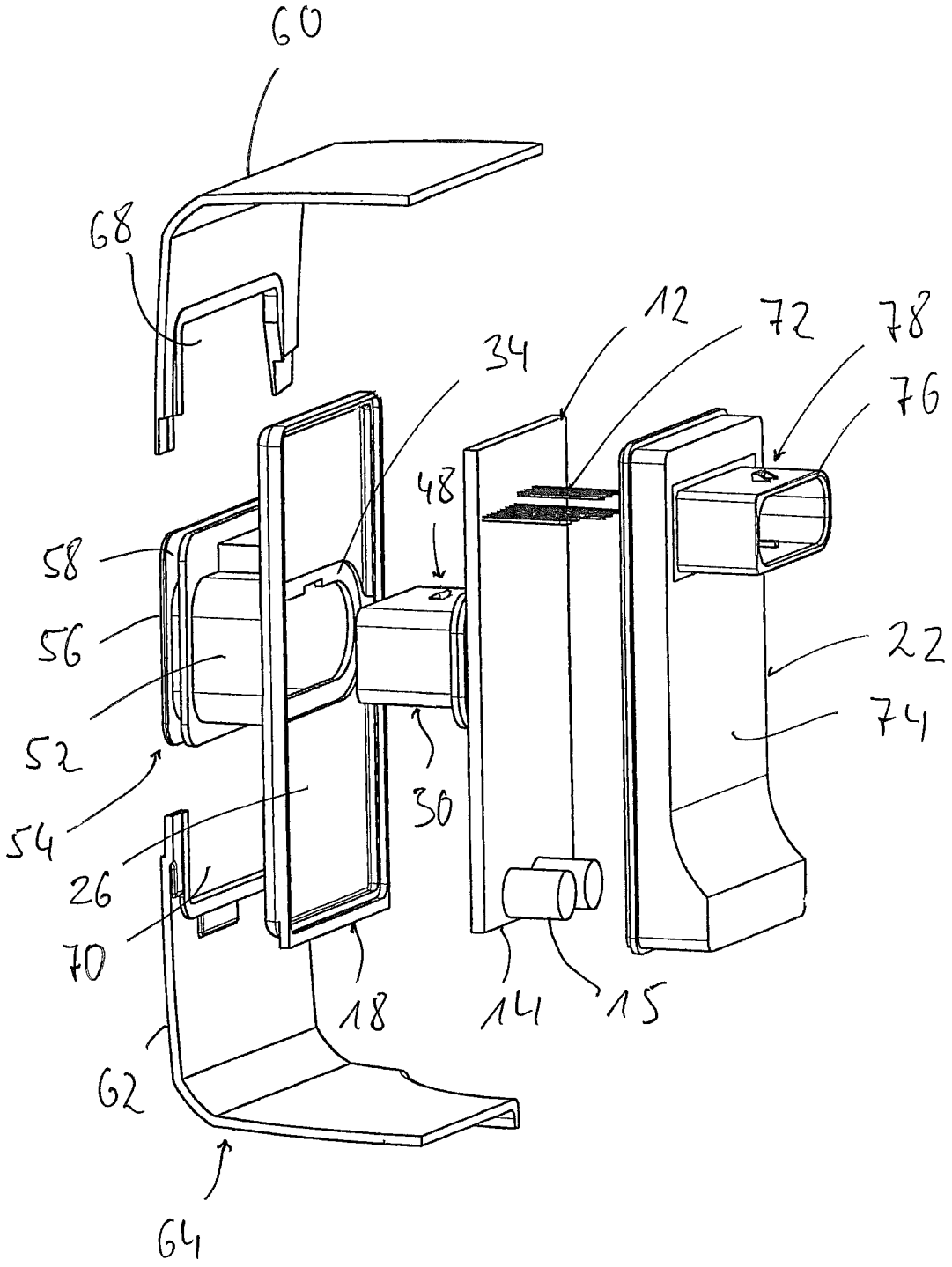
FIG. 2 is a perspective exploded view, corresponding to FIG. 1 as viewed from another perspective.
Figure 3:
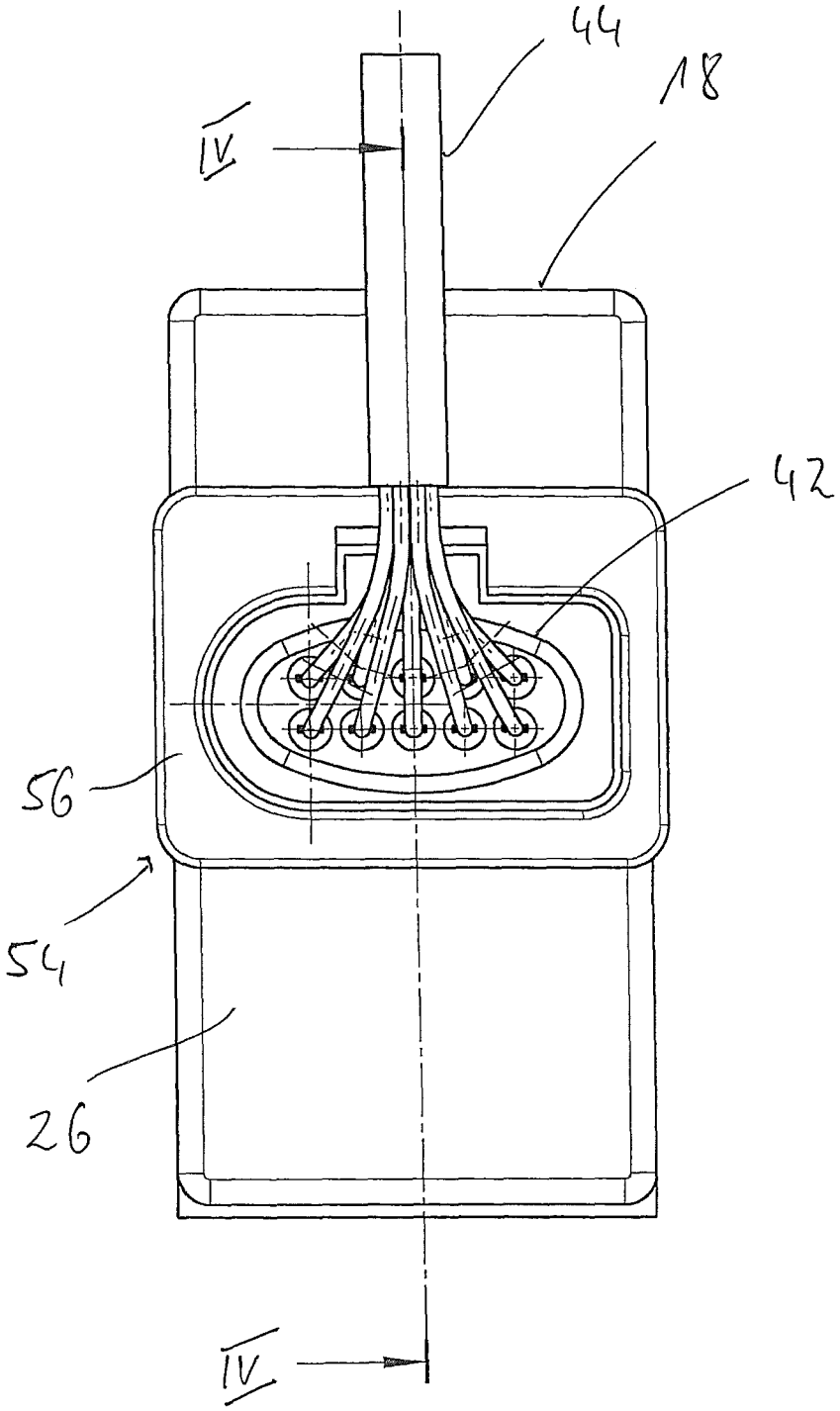
FIG. 3 is a top view of a control device for a vehicle heater with an external plug plugged onto it.

Referring to the drawings, FIGS. 1 and 2 show, viewed in different directions and in an exploded view, a control device generally designated by 10 for a vehicle heater. The control device 10 comprises as its central component a circuit assembly unit 12, which may be designed, for example, with a printed circuit board 14 with a plurality of electrical circuit elements 15 provided thereon.

Figure 4:
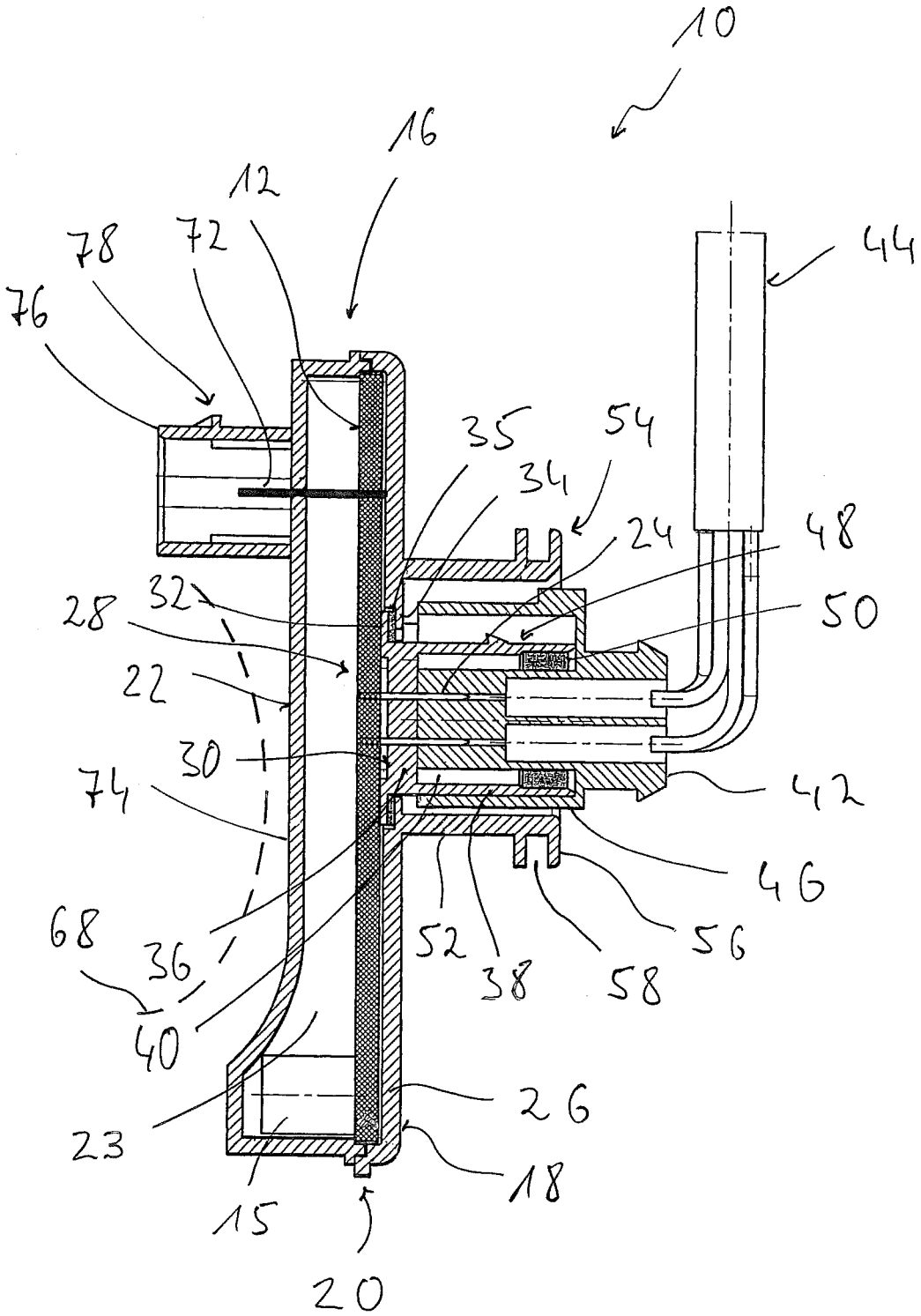
FIG. 4 is a sectional view of the control device along the section line IV-IV in FIG. 3.

A circuit assembly unit housing generally designated by 16 is formed to encapsulate the circuit assembly unit 12. The circuit assembly unit housing 16 comprises a first circuit assembly unit housing part 18 with an essentially plate- or shell-shaped configuration and a second circuit assembly unit housing part 22, which is likewise of a plate-like or shell-like design and can be connected thereto in a connection area 20 rigidly and especially also in a fluid-tight manner. In an assembled state, which is also shown in FIG. 4, the two circuit assembly unit housing parts 18, 22 form an interior space 23, in which the circuit assembly unit 12 is fixed, for example, by being clamped between the two circuit assembly unit housing parts 18, 22.

The circuit assembly unit 12 comprises a plurality of external contacts 24 extending from this essentially at right angles to the printed circuit board 14. These external contacts 24 are arranged approximately in a longitudinal central area of the printed circuit board 14, which is, for example, approximately rectangular. Associated with the external contacts 24 or in the area in which these external contacts 24 are arranged, an opening 28 is provided in a plate- or shell-like, first housing section 26 of the first circuit assembly unit housing part 18. An external receptacle 30 is positioned in the area of this opening 28. This receptacle 30 overlaps with a flange area 32 the first housing section 26 in its edge area 34 surrounding the opening 28. A ring-shaped sealing element 35 may be arranged between this edge area 34 and the flange area 32 in order to ensure a fluid-tight connection between the first circuit assembly unit housing part 18 and the external receptacle 30.

In the assembled state, the external receptacle 30 may be held rigidly on the circuit assembly unit 12, on the one hand, by the external contacts 24, which pass through a bottom area 36 of said external receptacle 30, for example, with press fit in corresponding openings. Further, the flange area 32 can be secured between the edge area 34 and the printed circuit board 14 under the prestressing action of the elastic sealing element 34. Further, the external receptacle 30 may also be fixed on the printed circuit board 14 or the circuit assembly unit 18, for example, by bonding or other measures.

The external receptacle 30 is formed with a circumferential wall 38 originating from the bottom wall 36, so that a receptacle recess 40 is formed by the bottom wall 36 and the circumferential wall 38. An external plug 42 of a cable harness 44, which brings about the wire connection to a vehicle wiring system, can be plugged into this receptacle recess 40 such that an electrical contacting is established with the external contacts 24 of the circuit assembly unit 18, which said external contacts protrude into the receptacle recess 40. The external plug 42 may be designed in this case such that it surrounds the circumferential wall 38 of the external receptacle 30 with a sleeve-like section 46. To ensure stable holding of the external plug 42 on the external receptacle 30, a holding formation 48, for example, in the form of a plurality of snap-in projections or the like, which can be brought, e.g., into a snap-in meshing that can be released, e.g., by the application of a pulling force, may be formed, for example, on the circumferential wall. Other measures, e.g., the provision of snap-in recesses or catch springs or the like, may also ensure a stable connection here.

It can, further, be recognized that a sealing element 50, which surrounds the external plug 42 and which can engage in a sealing interaction with the circumferential wall 38 of the external receptacle 30 in order to ensure a fully fluid-tight sealing in the area of the first circuit assembly unit housing part 18 with the external plug 42 plugged in, may be provided, for example on the external plug 42. It should be noted in this connection that in the embodiment shown in FIGS. 1 through 4, the external receptacle 30 is shown as a component made separately from the first circuit assembly unit housing part 18. It is easily possible in this manner to form such undercut areas, as they occur in the area of the snap-in projections of the holding formation 48, on the external receptacle 30, which is manufactured, in general, from a plastic material, for example, in a die-casting operation or the like.

Associated with the external receptacle 30, an external receptacle tunnel 52 is provided, for example, likewise designed as an integral component of the first circuit assembly unit housing part 18. This tunnel 52 extends from the first housing section 26, surrounding the external receptacle 30 and the circumferential wall 38 thereof, approximately to the same extent as the external receptacle 30. This means that the external receptacle tunnel 52 is arranged such that it surrounds the external receptacle 30 essentially in the entire section over which it extends starting from the first housing section 26 and over the entire circumference thereof.

In its end section located at a distance from the first housing section 26, the external receptacle tunnel 52 is formed with a holding meshing formation 54. This comprises a meshing groove 58, which is formed preferably over the entire circumference of the external receptacle tunnel 52 in an area 56 extending in a radially outward direction in a flange-like manner and is also correspondingly open in the outward direction. Meshing with this meshing groove 58, two housing parts 60, 62 of a heater housing 64, which is shown in some areas only, may be inserted. As this is illustrated in FIG. 1, the two housing parts 60, 62 fully surround here the flange-like area 56 and mesh with the meshing groove 58 over the entire circumference of said area. A connection of the external receptacle tunnel 52 to the heater housing 64, which connection is advantageously but not necessarily fluid-tight, is thus achieved. Since the meshing groove 58 is arranged at a spaced location from the first housing section 26 of the first circuit assembly unit housing part 18, an intermediate space, through which heating air, being delivered, for example, by a blower 68 indicated only schematically in FIG. 4, can flow, is formed between the circuit assembly unit housing part 16 and the heater housing 64. This contributes to the cooling of the control device 10, on the one hand, and the flow of the heating air within the heater housing 64 is compromised hereby only insignificantly, on the other hand.

It should be noted in this connection that for an increased variability in the assembly of a vehicle heater, it is possible, for example, to design the two housing parts 60, 62 on two mutually diametrically opposite areas in such a way that the recesses 68, 70 recognizable in FIG. 1 are provided for receiving the flange area 56. Depending on the installation situation, the control device 10 can be inserted on one side or the other, and a plate closing the two recesses 68, 70, for example, a plate made of a flexible material, can be inserted on the side on which the control device 10 is not provided in the particular case.

To connect the control device 10 electrically to a heater housing component, for example, the blower motor 68 mentioned already, the circuit assembly unit 12 has, further, internal contacts 72. These extend on the side of the printed circuit board 14 that is the opposite side in relation to the external contacts 24 and offset thereto in the longitudinal direction of the printed circuit board 14. Associated with the internal contacts 72, the second circuit assembly unit housing part 22 has passage openings for the internal contacts 72 in a second housing section 74 having a plate-like or shell-like design. An internal receptacle tunnel 76 is provided on the second housing section 74 in the area of these passage openings, for example, as an integral part of the second circuit assembly unit housing part 22, such that it extends in a direction opposite the external receptacle tunnel 52 and offset in relation to this in the longitudinal direction of the printed circuit board 14. The internal receptacle tunnel thus forms an area into which an internal plug of a cable, which leads, for example, away from the blower motor, can be plugged to establish an electrical contact with the internal contacts 72. An additional holding formation 76, for example, with a plurality of snap-in projections or/and snap-in recesses, may be formed on the internal receptacle tunnel 76 in order to make it possible to establish a stable connection with an internal plug.

Figure 5:
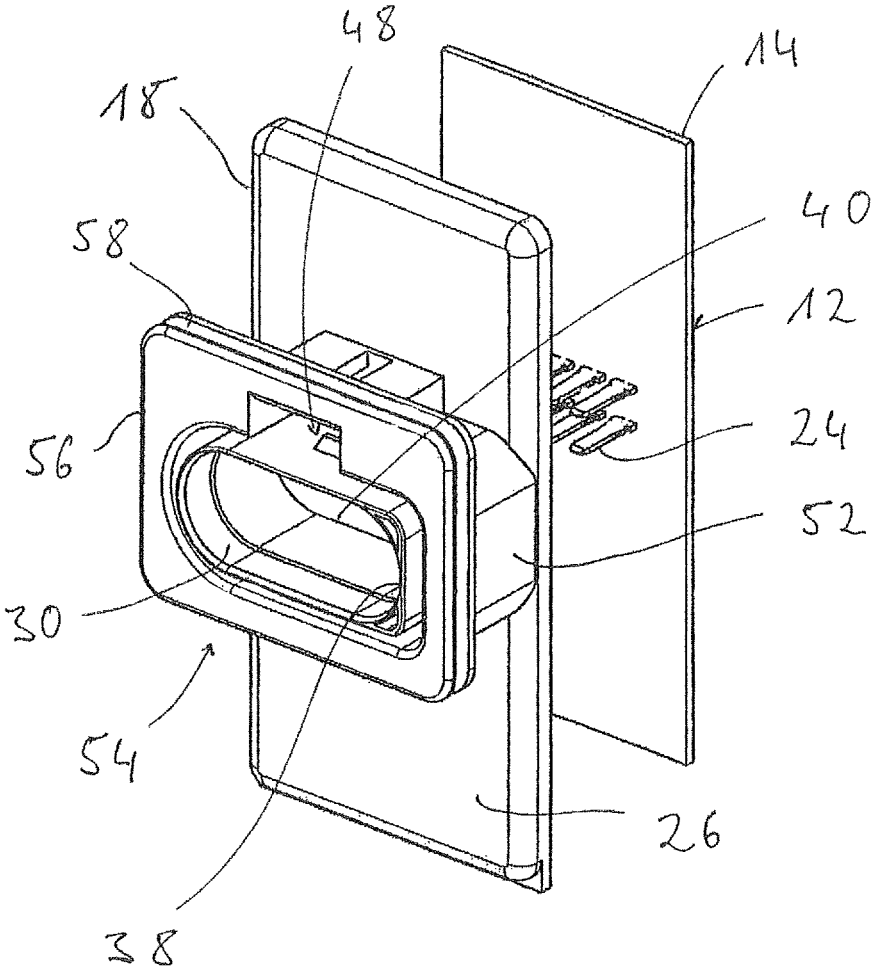
FIG. 5 is a perspective view of a circuit assembly unit housing part with an external receptacle tunnel provided integrally thereon and with an external receptacle provided integrally thereon.
Figure 6:
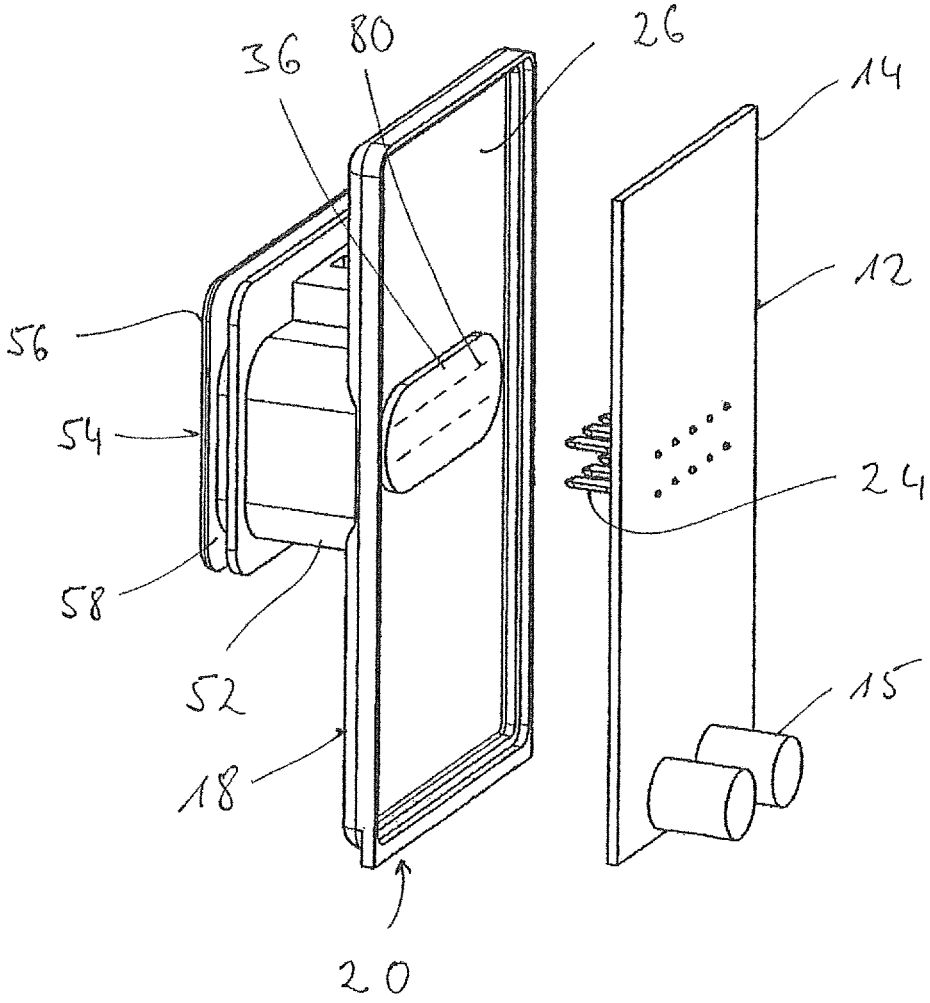
FIG. 6 is the circuit assembly unit housing part according to FIG. 5 in another perspective view.

An alternative type of embodiment of the first circuit assembly unit housing part 18 is shown in FIGS. 5 and 6. The first circuit assembly unit housing part 18 is provided with the plate- or shell-like first housing section 26, on which the external receptacle tunnel 52 is provided as an integral component, i.e., as a component forming a block of material, in this embodiment as well. In addition, the external receptacle 30 surrounded by the external receptacle tunnel 52 also forms in this embodiment with its circumferential wall 40 and its bottom wall 36 an integral component of the first circuit assembly unit housing part 18. The first assembly unit housing part 18 may be manufactured together with the external receptacle tunnel 52 and with the external receptacle 30, for example, in a casting operation from a plastic material. If corresponding casting molds are used, the snap-in projections providing the holding formation 48 may be formed integrally in one piece. As an alternative, the holding formation 48 could comprise, especially in this embodiment, one or more separately formed holding elements, for example, catch springs or the like.

Associated with the external contacts 24, a plurality of slot-like openings 80 are provided in the bottom wall 36, which seals the receptacle recess 40 in the direction of the interior space 23 and which may be located somewhat offset in relation to the first housing section 26, but may also be positioned flush with this, i.e., in one plane. In the assembled state, the external contacts 24 extend into the receptacle recess 40 of the external receptacle 30 through these openings 80, whose shape and dimensioning are adapted to the shape and dimensioning of the external contacts 24. To guarantee an essentially fluid-tight sealing here, the external contacts 24 may be received in the openings 80 associated with these preferably with an essentially clearance-free press fit. As an alternative, or in addition, a fluid-tight sealing can be guaranteed, for example, by introducing an adhesive-like sealant or the like.

The functionality of the first circuit assembly unit housing part 18 shown in FIGS. 5 and 6, which is formed integrally with the external receptacle tunnel 52 and the external receptacle 30, during the interaction with an external plug 42 corresponds to the functionality described above with reference to FIGS. 1 through 4. Because of the integral design, which can be recognized in FIGS. 5 and 6, the number of individual components can be reduced. Further, the provision of an additional sealing point at the area in which two mutually separate components adjoin each other can be avoided.

The above-described design of a control device 10 for a vehicle heater can be achieved in a very simple manner. The two circuit assembly unit housing parts 18, 22, which can be manufactured in a simple and cost-effective manner in a die-casting operation from a plastic, and which encapsulate the circuit assembly unit 12 essentially completely in conjunction with the external receptacle 30 and also ensure the stable holding thereof in the interior space 24 due to a corresponding design in the assembled state, are essentially to be provided for this. At the same time, holding of the control device 10 in variable position can be achieved due to the holding of the external receptacle tunnel 52 on the heater housing 64.

Since, in particular, the cable harness 44, via which a plug-type connection to a vehicle wiring system is to be achieved, is not to be connected rigidly, e.g., by soldering, to the circuit assembly unit 12, this cable harness 44 may be selected in adaptation to the particular intended purpose, i.e., for example, a particular vehicle accommodating the vehicle heater.

It should finally be noted that the principles of the present invention can, of course, also be applied in case of a different design, for example, of the circuit assembly unit housing or even of the circuit assembly unit itself. In particular, the circuit assembly unit housing could also be formed with more than two housing parts. The circuit assembly unit itself could also have a plurality of printed circuit boards accommodated in the circuit assembly unit housing or corresponding circuitry components.

While specific embodiments of the invention have been shown and described in detail to illustrate the application of the principles of the invention, it will be understood that the invention may be embodied otherwise without departing from such principles.

What is claimed is:

1. A vehicle heater control device comprising:

a circuit assembly unit with a plurality of external contacts;

an external receptacle for receiving an external plug for establishing an electrical contact with the plurality of external contacts for connecting the control device to a vehicle wiring system; and a circuit assembly unit housing surrounding the circuit assembly unit and comprising an external receptacle tunnel extending from a first housing section of a first housing part of the circuit assembly unit housing surrounding the external receptacle in the entire section over which the external receptacle extends starting from the first housing section.

2. A control device in accordance with claim 1, wherein the external receptacle tunnel comprises a holding meshing formation for providing a holding meshing with a heater housing, said holding meshing formation being provided at an end section of said external receptacle tunnel, said holding meshing formation being located at a spaced location from said first housing section.

3. A control device in accordance with claim 2, wherein the holding meshing formation comprises a housing meshing groove for the holding meshing of at least one housing part of a heater housing.

4. A control device in accordance with claim 1, wherein:

the circuit assembly unit housing comprises a first circuit assembly unit housing part with a plate or shell first housing section carrying the external receptacle tunnel; and the plate or shell first housing section is formed integrally in one piece with the external receptacle tunnel.

5. A control device in accordance with claim 4, wherein the holding meshing formation on the external receptacle tunnel is arranged at a spaced location from the first housing section, said section of said external receptacle is arranged in an interior of said external receptacle tunnel.

6. A control device in accordance with claim 4, wherein the first circuit assembly unit housing part is sealed in an essentially fluid-tight manner in relation to the external receptacle.

7. A control device in accordance with claim 4, wherein the external receptacle tunnel and the external receptacle are formed integrally with the first circuit assembly unit housing part with a casting process from a plastic material.

8. A control device in accordance with claim 1, further comprising a holding formation establishing a holding connection with an external plug, the holding formation being provided on at least one of the external receptacle and the external receptacle tunnel.

9. A control device in accordance with claim 8, wherein the holding formation comprises at least one of a snap-in projection, a snap-in recess and a catch spring.

10. A control device in accordance with claim 1, wherein the external receptacle comprises a receptacle recess for receiving a contact area of an external plug, wherein the external contacts extend into the receptacle recess.

11. A control device in accordance with claim 4, wherein the circuit assembly unit comprises a plurality of internal contacts for establishing an electrical contact with an internal plug for connecting at least one heater component to the control device.

12. A control device in accordance with claim 11, wherein the circuit assembly unit housing further comprises an internal receptacle tunnel surrounding the internal contacts at least partially.

13. A control device in accordance with claim 12, wherein the circuit assembly unit housing further comprises a second circuit assembly unit housing part with a plate or shell second housing section carrying the internal receptacle tunnel and formed integrally in one piece with the internal receptacle tunnel.

14. A control device in accordance with claim 13, wherein the first housing section is connected with the second housing section, surrounding the circuit assembly unit.

15. A control device in accordance with claim 12, wherein the external receptacle tunnel and the internal receptacle tunnel are arranged offset in relation to one another on the circuit assembly unit housing.

16. A control device in accordance with claim 1, wherein the circuit assembly unit comprises at least one printed circuit board.

17. A vehicle heater, comprising:

a heater housing; and a control device comprising:

a circuit assembly unit with a plurality of external contacts, said circuit assembly unit comprising a housing section;

an external receptacle for receiving an external plug for establishing an electrical contact with the plurality of external contacts for connecting the control device to a vehicle wiring system; and a circuit assembly unit housing surrounding the circuit assembly unit and comprising an external receptacle tunnel extending from said housing section, said external receptacle tunnel surrounding the external receptacle in an entire section over which the external receptacle extends starting from the housing section, wherein the control device is carried on the heater housing by means of a connection of the heater housing and the external receptacle tunnel.

18. A vehicle heater control device comprising:

a circuit assembly unit housing defining an interior space, said circuit assembly unit housing comprising a housing section;

a circuit assembly unit with a plurality of external contacts, the circuit assembly unit being disposed within the interior space;

an external receptacle for receiving an external plug for establishing an electrical contact with the plurality of external contacts for connecting the control device to a vehicle wiring system, said external receptacle comprising an external receptacle section, said external receptacle section extending from a position adjacent to said housing section to a position located at a spaced location from said housing section; and an external receptacle tunnel integrally connected to the circuit assembly unit housing, said external receptacle tunnel extending continuously, without interruption from said housing section to an external receptacle tunnel position located at a spaced location from said housing section, said external receptacle tunnel completely surrounding the external receptacle section.

19. A vehicle heater control device according to claim 18 in combination with a heater housing, wherein:

the heater housing comprises a housing part with an engagement structure; and the external receptacle tunnel comprises a holding engagement formation for providing a holding engagement with the engagement structure of the housing part, said holding engagement formation being provided at an end section of said external receptacle tunnel, said holding meshing formation being located at a spaced location from said housing section.

20. A vehicle heater control device in accordance with claim 19, wherein:

the holding engagement formation comprises a housing engagement groove for the engaging a flange of the housing part;

the circuit assembly unit housing comprises said housing part with a plate or said shell housing section carrying the external receptacle tunnel and another housing section;

the housing section and the another housing section cooperate to provide the interior space;

the external receptacle section is located in an interior of said external receptacle tunnel; and the plate or shell first housing section is formed integrally in one piece with the external receptacle tunnel.

* * * * *